United States Patent [19]

Reinke et al.

[11] Patent Number: 5,036,590

[45] Date of Patent: Aug. 6, 1991

[54] DECORATIVE RIBBON SLITTER

[76] Inventors: Arthur J. Reinke; Sandra K. Reinke, both of 630 Marion, NE., Suite 160, Salem, Oreg. 97301

[21] Appl. No.: 645,501

[22] Filed: Jan. 24, 1991

Related U.S. Application Data

[63] Continuation of Ser. No. 408,554, Sep. 18, 1989, abandoned.

[51] Int. Cl.[5] ..... B26B 3/04; B26B 5/00

[52] U.S. Cl. ..... 30/304; 30/261; 30/287

[58] Field of Search ..... 30/261, 287, 294, 304, 30/305, 363, DIG. 3

[56] References Cited

U.S. PATENT DOCUMENTS 888,297 5/1908 Bell ..... 30/363

3,372,482 3/1968 Mercorelli ..... 30/363

3,883,953 5/1975 Saullo et al. ..... 30/304

*Primary Examiner*—Hien H. Phan

*Attorney, Agent, or Firm*—Eugene D. Farley

[57] ABSTRACT

A decorative ribbon slitter for subdividing a ribbon into shreds of predetermined width. A plurality of longitudinally spaced, ribbon-shredding teeth are mounted on the inner surface of one of a pair of jaw members for engaging the ribbon in the closed position of the jaw members and slitting it into shreds having a width determined by the spacing of the teeth. The teeth preferably are provided with an interchangeable slide and guide combination enabling the operator to mount in the slitter a selected slide having thereon a plurality of slitting teeth arranged in a pattern predetermined to yield shreds of a desired width.

2 Claims, 1 Drawing Sheet

DECORATIVE RIBBON SLITTER

This is a continuation of application Ser. No. 07/408,554, filed Sept. 18, 1989.

BACKGROUND AND GENERAL STATEMENT OF THE INVENTION

This invention relates to decorative ribbon slitters of the class employed for longitudinally shredding a ribbon into strands which may be curled, as is commonly done in the craft, floral and gift shop trades.

In such trades it is common practice to slit or shred the ends of ribbons to create an artistic or ornamental effect on wrapped packages. This also is commonly done in household applications when it is desired to gift wrap a package.

The most common practice is to perform the slitting operation manually, cutting the ribbons by hand. This is difficult to do, particularly if it is desired to create a stranded product the components strands of which are of exactly the same width, or have side edges which are exactly parallel to each other.

There also are various tools known to the prior art for achieving this operation.

It is the general purpose of the present invention to provide a decorative ribbon slitter including a kit of individual ribbon slitting components having teeth or knives arranged in various spacing patterns so that the components may be used interchangeably as required to create desired effects in the finished product.

It is a further object of the present invention to provide a decorative ribbon slitter which is simple and inexpensive to manufacture, efficient in operation, adaptable for use on a variety of ribbon materials, and easy to use.

Broadly considered, the decorative ribbon slitter of our invention, which accomplishes the foregoing and other objects, comprises first and second jaw members and hinge means hinging the jaw members together at one of their ends for angular movement relative to each other between open and closed positions.

Aligned openings are present through the jaw members adjacent the hinge. A post stop is mounted in the openings for limiting the degree of opening of the jaw members. Resilient means are mounted on the post stop for biasing the jaw members in the direction of their open position.

A plurality of longitudinally spaced, ribbon-slitting teeth are mounted on the inner surface of one of the jaw members for engaging the ribbon in the closed position thereof, and for slitting it into shreds having a width determined by the spacing of the teeth as the ribbon is drawn through the slitter.

In particular, the slitter is characterized by the presence of a longitudinal slide or groove on the inner face of one of the jaw members and by a plurality of associated tooth-mounting slides which may be mounted interchangeably in the groove. This makes possible creating various patterns of shredded products, depending upon the spacing of the teeth in the various slide components.

THE DRAWINGS

DESCRIPTION OF PREFERRED EMBODIMENTS OF THE INVENTION

Figure 1:
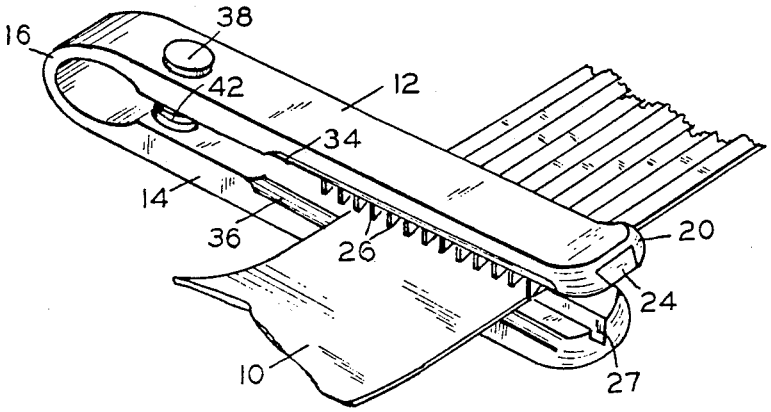
FIG. 1 is a top perspective view of the decorative ribbon slitter of our invention in its open position.
Figure 2:
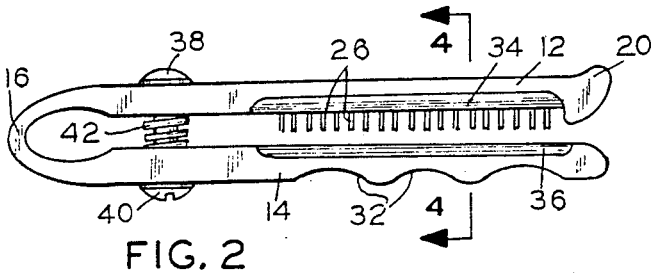
FIG. 2 is a view in side elevation of the slitter, also in its open position.

As indicated above, the appliance of my invention is designed to slit into shreds or narrow strips a length of sheet material 10. The sheet material may comprise any slittable material such as sheet plastic, fabric, paper, foil or raw plant products such as corn husks and leaves. It is characterized herein as a ribbon, although no limitation thereby is intended.

The slitting apparatus preferably is formed from a continuous length of structural material such as a plastic having inherent resiliency. It comprises an upper jaw 12 and a lower jaw 14 connected by an integral hinge 16. The two jaws are relatively thick and resist deformation upon the application of pressure. However, the hinge segment 16 is thinned down and displays the resiliency inherent in the plastic.

Figure 3:
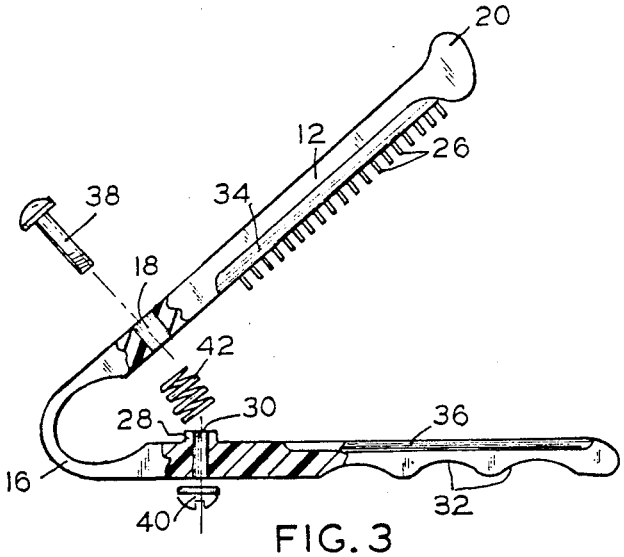
FIG. 3 is an exploded view in side elevation, partly broken away, showing the slitter in the separated position of its components.
Figure 6:
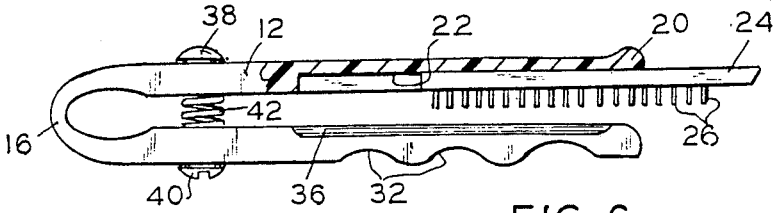
FIG. 6 is a view in side elevation, partly broken away, illustrating an embodiment of the slitter incorporating interchangeable slitting elements.

As shown particularly in FIGS. 3 and 6, upper jaw 12 is provided, adjacent hinge 16, with a transverse opening 18. It also is provided on the terminal portion of its upper surface with a thumb stop 20. Its underside has a longitudinal groove or guideway 22.

Figure 4:
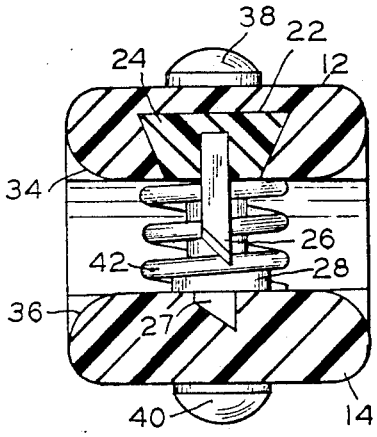
FIG. 4 is an enlarged, transverse sectional view taken along line 4—4 of FIG. 2, illustrating the slitter in its open, at rest position.

Guideway 22 preferably is trapezoidal in cross section, FIG. 4. It is dimensioned to receive an elongated slide 24 on the outer surface of which are mounted a plurality of longitudinally spaced teeth or knives 26. These may be secured in the slide by press-fitting them into grooves, or by molding them into the plastic.

As illustrated, guideway 22 and slide 24 are contoured to form a sliding dovetail joint which makes possible the rapid and facile interchange of the two assemblies.

A relief 27 in the jaw surface opposite teeth 26 makes more positive and accurate the ribbon-slitting operation.

The spacing between teeth 26 determines the width of the narrow strips cut by the slitter. In practice, it is contemplated that there be provided a plurality of tooth assemblies each having a predetermined tooth spacing and each being interchangeably insertable in guideway 22. In this manner the tool may be applied to the slitting of ribbons into narrow strips of different widths.

Lower jaw 14 is provided, adjacent hinge segment 16, with an inwardly extending boss 28 which acts as a stop to limit the degree of closure of the jaws. It also is provided with a transverse opening 30 which registers with opening 18 in upper jaw 12 in the closed position of the tool.

The outer surface of lower jaw 14 is shaped with a plurality of finger recesses 32 to increase the facility with which the tool may be used.

Upper jaw 12 has along its inner longitudinal margins a recessed portion 34. Lower jaw 14 has along its inner longitudinal margins a matching cutaway portion 36. These form a guideway for the ribbon as it is fed against the teeth in the operation of the slitter.

Combination post and stop means are provided for confining the upper and lower jaws between limits as they move between open and closed positions.

As shown particularly in FIGS. 3 and 4, the post means supplied for this purpose comprises a bolt 38 with a nut 40. The bolt is dimensioned to be received in registering openings 18, 30 through the upper and lower jaws respectively. It mounts a compression type coil spring 42 one end of which seats on the boss 28 which is present on the inner surface of lower jaw 14.

OPERATION

Figure 5:
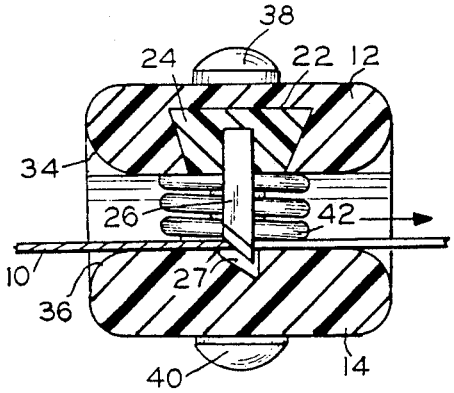
FIG. 5 is an enlarged, transverse sectional view similar to FIG. 4, but illustrating the slitter in its closed operative position.

The manner of operation of the herein described ribbon slitter is particularly apparent from a consideration of FIGS. 1 and 5.

A ribbon 10 or other piece of slittable material is fed into the tool. The jaws then are pressed together against the force of compression spring 42, as shown in FIG. 5. The ribbon next is drawn through the slitter the teeth of which subdivide it into shreds or narrow strips having widths determined by the spacing of the teeth.

At the conclusion of the operation, the pressure on the jaws is released whereupon the spring 42 returns them to their open position. The action of the tool is such that it imparts a curl to the slit shreds. This may be enhanced by drawing the ribbon over a knife blade or similar implement either before or after slitting it.

The sequence may be repeated as often as is necessary or desired, inserting a sequence of slides 24 in guides 22 in order to obtain desired patterns of slits in the work.

Having thus described in detail preferred embodiments of the present invention, it will be apparent to those skilled in the art that various physical changes may be made in the invention described without altering the inventive concepts and principles embodied. The present embodiment is therefore to be considered as illustrative and not restrictive, the scope of the invention being indicated by the appended claims.

I claim:

1. A decorative ribbon slitter comprising:

a) a continuous length of resilient plastic material reversely bent and thinned centrally of its length to form opposed upper and lower jaws interconnected by a thinned, resilient hinge segment, the jaws being adjustable bteween open and closed positions, b) a longitudinally disposed guide on the inner surface of one of the jaw members, c) a plurality of slides dimensioned for interchangeable reception in the guide in sliding dovetail joint relation, d) a plurality of longitudinally spaced, ribbon slitting teeth or knives mounted on each slide and arranged for engaging the ribbon in the closed position of the jaw members and for slitting it into shreds having a width determined by the spacing of the teeth as the ribbon is drawn through the slitter, e) spring-biased post stop means interconnecting the jaws for limiting the degree of their opening and closing and maintaining them normally in their open position, and f) cooperating ribbon guideway means on the opposed surfaces of both jaws to feed the ribbon to the teeth.

2. The decorative ribbon slitter of claim 1 including a relief in the jaw surface opposite the teeth, dimensioned and contoured for receiving the teeth in the closed position of the jaws to make more positive and accurate the ribbon slitting operation and including also a plurality of integral finger recesses on the outer surface of one of the jaws to facilitate gripping the slitter and holding it in proper position during the ribbon slitting operation.

* * * * *